US007322154B2

(12) United States Patent
Forbis, Sr. et al.

(10) Patent No.: US 7,322,154 B2
(45) Date of Patent: Jan. 29, 2008

(54) COOLING SHADE ASSEMBLY AND METHOD OF USE THEREOF

(76) Inventors: Jack R. Forbis, Sr., 283 Sundown Dr., Waco, TX (US) 76712; Ann R. Forbis, 283 Sundown Dr., Waco, TX (US) 76712

( * ) Notice: Subject to any disclaimer, the term of this patent is extended or adjusted under 35 U.S.C. 154(b) by 0 days.

(21) Appl. No.: 11/317,151

(22) Filed: Dec. 23, 2005

(65) Prior Publication Data

US 2006/0117668 A1 Jun. 8, 2006

Related U.S. Application Data

(63) Continuation of application No. 10/393,619, filed on Mar. 21, 2003, now abandoned.

(60) Provisional application No. 60/366,226, filed on Mar. 21, 2002.

(51) Int. Cl.
*E04B 7/14* (2006.01)

(52) U.S. Cl. ..... 52/3; 52/6; 52/168; 52/222; 52/745.06; 52/79.1; 47/20.1; 47/31; 47/21.1; 160/371; 160/380

(58) Field of Classification Search ..... 52/1, 52/3, 4, 5, 168, 222, 745.06, 63, 79.1; 47/20, 47/26, 27, 28.1, 31, 20.1, 21.1; 135/88.1, 135/88.11; 160/87, 135, 371, 380, DIG. 7
See application file for complete search history.

(56) References Cited

U.S. PATENT DOCUMENTS

| | | | | |
|---|---|---|---|---|
| 4,068,404 | A * | 1/1978 | Sheldon | 47/22.1 |
| 5,083,396 | A * | 1/1992 | Traut | 47/22.1 |
| 5,451,445 | A * | 9/1995 | Wang | 428/131 |
| 5,791,090 | A * | 8/1998 | Gitlin et al. | 52/4 |
| 5,966,877 | A * | 10/1999 | Hawes | 52/63 |
| 5,992,088 | A * | 11/1999 | Henningsson et al. | 47/22.1 |
| 6,161,362 | A * | 12/2000 | Forbis et al. | 52/745.06 |
| 6,546,745 | B2 * | 4/2003 | Torres et al. | 62/259.1 |

* cited by examiner

*Primary Examiner*—Jeanette Chapman
(74) *Attorney, Agent, or Firm*—Dunlap Codding & Rogers, P.C.

(57) ABSTRACT

A shade assembly including reflective shade panels suspended above a roof or along an exterior wall of a building. The assembly also includes a shade box, such as one including an assembly of upright support posts and attached cables to which dark or reflective water-absorbent shade panels are attached. The shade box covers a rooftop fixture. The shade box can also include a water distribution system which dispenses water substantially onto the dark shade panels when they are included in the shade box. The shade assembly may also be used in a method for cooling the exterior surface of a building. The shade assembly may be used in a method of obtaining government economic incentives for energy efficiency such as emission reduction credits. A shade assembly including reflective shade panels suspended above a structure on or near the ground, such as a parking lot.

25 Claims, 3 Drawing Sheets

COOLING SHADE ASSEMBLY AND METHOD OF USE THEREOF

CROSS REFERENCED TO RELATED APPLICATIONS

This application is a continuation of U.S. Ser. No. 10/393,619, filed Mar. 21, 2003 now abandoned, which claims priority under 35 U.S.C. § 119(e) to U.S. Provisional Patent Application No. 60/366,226, filed on Mar. 21, 2002, the contents of which are hereby incorporated herein by reference in their entirety.

STATEMENT REGARDING FEDERALLY SPONSORED RESEARCH OR DEVELOPMENT

Not applicable.

TECHNICAL FIELD OF THE INVENTION

The present invention relates to a shade assembly and in particular a shade assembly for the exterior surface of a building and adjacent areas or parking lots and methods of use thereof.

BACKGROUND OF THE INVENTION

Heat, a form of kinetic energy, is generally transferred in three ways: conduction, convection and radiation. The transfer of heat energy by radiation makes possible the transfer of large amounts of heat from the sun to the earth. Radiation transfers the sun's heat to exposed surfaces, such as the roof or wall of a building or parked cars.

When the air inside a building is cooler than the roof and outside air, conduction will carry heat through the roof where it is distributed into an attic space or other interior areas near the roof by radiation and convection. Similarly, heat can also be transferred through the exterior walls of a building to its interior. Heat may also be conducted away from the interior of a building through the roof and other exterior surfaces to the outside air if the interior air is warmer.

Several ways of reducing roof temperatures as well as blocking heat from entering windows have been developed and put into practice. Some of these include the application of water spray or mist alone to rooftops, the application of white, reflective coatings to a roof surface (the "cool roof" technology), and even placing containers of plants on a roof. A few types of shading panels have been developed to shade air conditioning units, but they are typically constructed of metal and/or fiberglass, and often stay hot due to the reradiation of heat on those panels. The reradiated heat, if not removed, is transferred into the building.

Parking lots have also been covered to block sun and/or rain. Such coverings, if water-repellant, required specifically designed support structures. Also, some coverings use materials that are not efficient at blocking or reflecting solar radiation. Such covers may still allow a parking lot to become quite warm as the covers heat up and transfer the heat by conduction to underlying air.

Insulation materials have been improved over the years and adding extra insulation underneath rooftops or walls can help prevent heat from flowing through a building's roof and walls. However, insulation merely retards heat flow into the building from the exterior surfaces rather than preventing or reducing the heating of the exterior surfaces. Insulation is generally not used in parking lot covers at all.

Prevention is a key strategy in types of energy saving devices and products such as cool roof coatings and exterior solar screens installed on the outside of window frames. Austin Energy stated in a press release dated Jun. 7, 2000, under "Biggest Money Saving Improvements", that one of the four "key home energy improvements that provide the greatest energy savings" is the installation of solar screens on the outside of windows that are hit by direct sunlight. Such screens prevent 60%-70% of sunlight/heat that would normally pass through the windows from entering the house. However, this technology affects only direct heat radiation entering a building through windows and fails to address the large amounts of heat absorbed by all exterior surfaces of a building.

In the case of cool roof coatings, they are mostly applied to flat or low-sloped rooftops in warm climate zones. The objective is to provide and maintain a high level of reflectivity along with a high degree of infrared emissivity so that heat "build up" on the rooftop is prevented by the turning away the sun's light and heat. These technologies can often be thwarted by peeling or cracking or other deterioration of the coating as well as by the accumulation of dirt on the coating which is difficult to remove and which reduces the performance of the cool roof technology. These and other problems are discussed in Kim, W. A., Rohm & Haas Co., "Selective Quality Coatings—Not All Roof Coatings Are Created Equal", —at http://www.energy-seal.com/es-web.nsf/newsroom/Selecting-Quality-Coatings, accessed Jan. 22, 2002. See also Robin Suttel, "Roofing in a Greener World" Buildings.com, (accessed Oct. 25, 2002 at http://www.buildings.com/Articles/details.asp?ArticleID=1063).

SUMMARY OF THE INVENTION

The present invention includes a shade assembly comprising an array of shade panels suspended slightly above a roof or top of a structure, such as a building. The assembly may also include a shade box with an assembly of at least two upright support posts, at least one cable attached to said posts and an array of dark or reflective shade panels attached to the cables. The shade box is sized to cover rooftop fixture such as an air conditioner unit or elevator equipment while still allowing for sufficient air flow.

Within the shade box there may be located at least one spray nozzle coupled to a water distribution system which dispenses water substantially onto the dark shade panels of the shade box. The water dispensation may be regulated and not continuous. The manner of regulation may involve an automated controller using information obtained from rooftop sensors or from local weather information readily available over the internet. Water used in the system may include collected rain water or recycled water from other uses within the building or reclaimed water from solar panels or fuel cells. This minimizes additional water consumption by the building as a whole. Embodiments in which reflective panels are utilized to form the shade box, water mist may be omitted.

The shade assembly may be located solely on the roof or top of a structure or it may include an array of reflective shade panels suspended along or attached to at least one exterior wall or surface of the structure, such as the wall of a building.

The invention also includes a shade assembly suspended above a structure on or close to the ground, such as a parking lot. The shade assembly may be made of reflective cloth that allows the passage of water, thereby allowing the assembly to be substantially horizontal or otherwise placed without regard to rain run-off.

The invention also includes a method of cooling an exterior surface of a structure such as a building by erecting a shade assembly which may cover the top portion such as a roof and/or exterior surfaces such as walls. Another aspect of the method relates to cooling of a structure on or close to the ground, such as a parking lot or items on such a structure, for example cars.

Additionally, the invention includes a method of reducing energy consumption using the shade assembly. In areas where emission reduction credits may be provided for energy efficiency improvement of a facility, the method also includes the generation and procurement of such credits.

The present invention presents a number of objects and advantages which include, but are not limited to:

Reduction in building energy use providing savings and economic advantages that exceed the cost of installation and maintenance of the shade assemblies;

Beneficial effects to local and/or regional air quality through reduction of energy-related emissions of pollutants such as $NO_x$, $SO_2$ and $CO_2$;

Beneficial effects such as reduction of the heat island effect of cities or large building groups;

Beneficial effects on roof, wall life and/or life of mechanical equipment and a reduction of maintenance required for such structural materials and equipment;

Retention of easy access to roof or wall structures;

Design flexibility to allow accommodation of existing exterior structures such as roof-mounted equipment, water collection assemblies, satellite dishes, antennae, solar panels, and lightning rods;

Provision of an improved shade assembly for parking lots that provides better reflectivity of solar energy than existing structures and, if water-permeable shade panels are used, allows greater flexibility and simplicity in assembly and design;

Coupled benefits achieved when a shade assembly for structures on or near the ground such as parking lots is used with a shade assembly covering all or part of another structure such as a building;

Reduction or elimination of the need for other shading structures, such as overhangs, currently employed which are far more resource-consuming.

The present invention allows some visible light to reach the roof while still preventing unwanted heating. Accordingly, it may make the use of skylights or other natural light sources in the roof or exterior of a building feasible in areas where they are otherwise inefficient or undesirable.

The present invention may be used on a variety of exterior surfaces of a building or adjacent surfaces, such as flat roofs, sloped roofs, multilevel roofs, walls and parking lots.

The invention may be assembled and used on existing structures or designed into new structures and may be easily modified to meet aesthetic requirements.

The present invention may be readily coupled with other energy-saving measures and may improve the efficiency of current energy systems, for instance by reducing peak electricity load on a power grid or by allowing the use of smaller fuel cells with a given structure.

For a better understanding of the invention and its advantages, reference may be made to the following description of exemplary embodiments and accompanying drawings.

DETAILED DESCRIPTION OF THE INVENTION

Specific embodiments of the present invention and their advantages are best understood by reference to FIGS. 1 through 6, where like numbers are used to indicate like and corresponding features.

Figure 1:
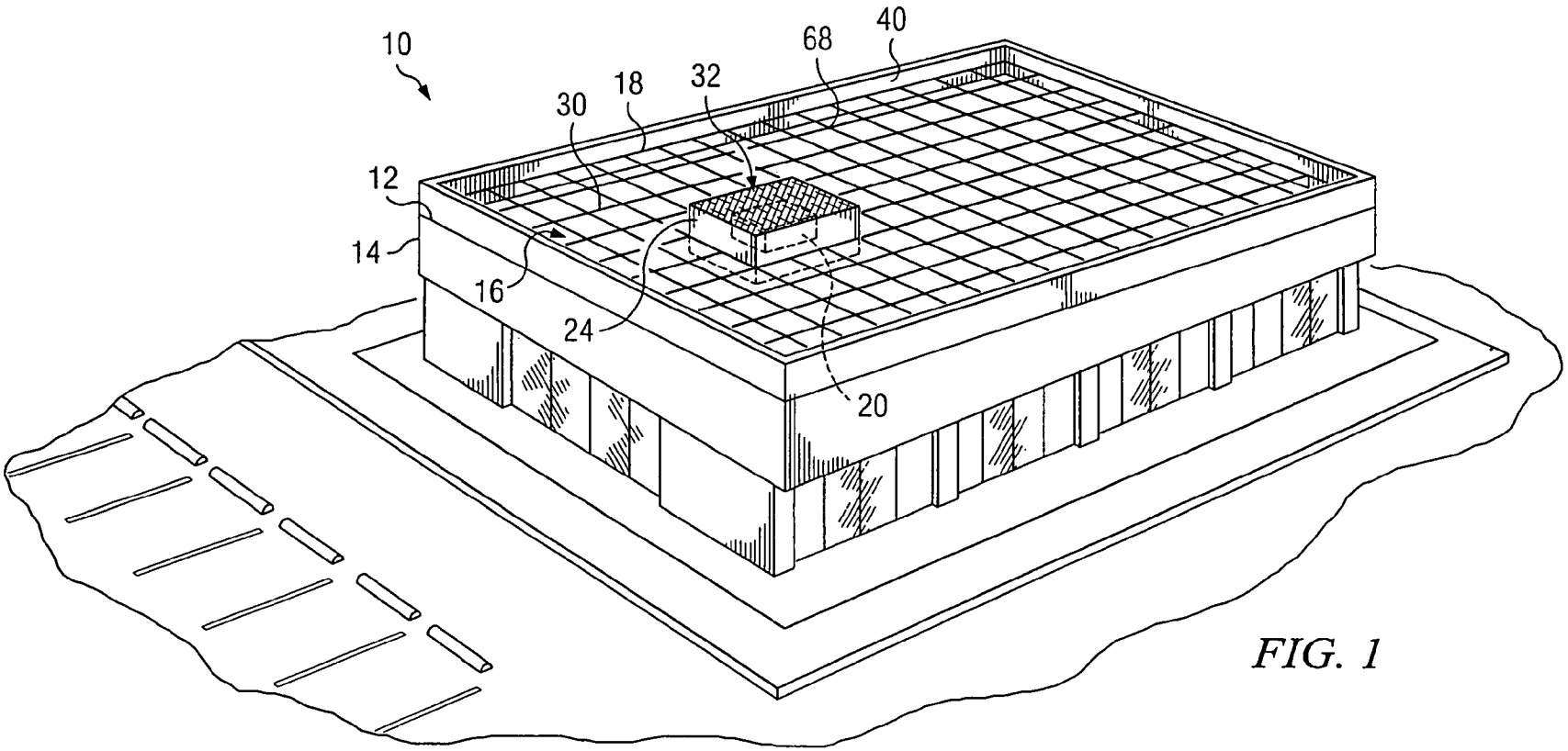
FIG. 1 illustrates an overhead perspective view of an office building having a flat roof surface on which a shade assembly is installed in a horizontal operative position according to the teachings of the present invention.

Referring to FIG. 1, roof shade assembly 10 is installed in an operative position overlying roof 12 of building 14 for the purpose of shielding roof 12 from solar radiation. Shade assembly 10 includes support assembly 68 formed from cables 30 attached to parapet wall 40 with anchors 18. Reflective shade panels 16 are fastened to cables 30 with fasteners such that panels 16 are in an operative, solar shielding position overlying and spaced above roof 12. Shade assembly 10 also includes shade box 32 with raised upright support posts 24 and dark or reflective shade panels attached thereto. Shade box 32 covers rooftop fixture 20.

Figure 2:
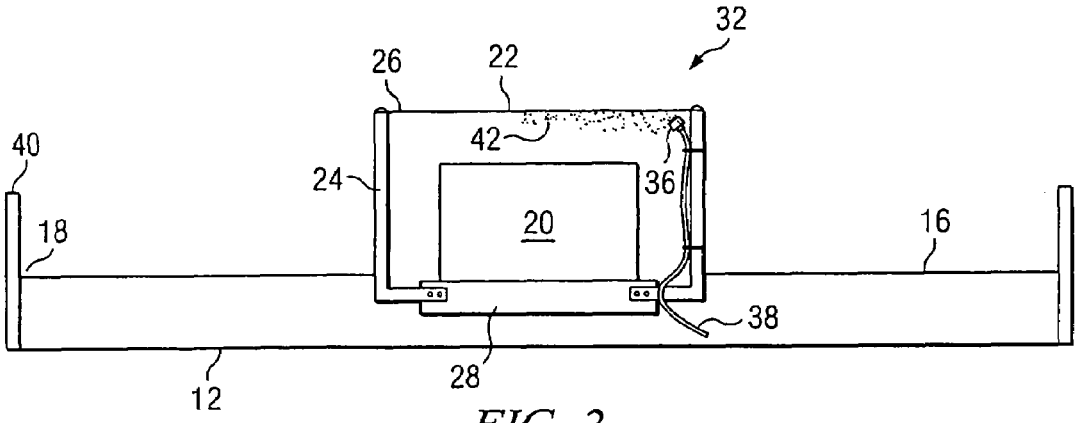
FIG. 2 illustrates a side view of a shade box according to the teachings of the present invention.

Referring to FIG. 2, reflective shade panels 16 are positioned at an operative level above roof 12 and are fastened to cables 30 which are attached by anchors 18 to parapet wall 40. Shade box 32 is installed in an operative position above rooftop fixture 20 by attaching support posts 24 to a base portion of fixture 20 or a support platform of fixture 28. Cables 26 are attached to the support posts 24 and dark shade panels 22 are attached to cables 26 with fasteners. The shade box may further include at least one spray nozzle 36 coupled to a water dispensation conduit 38 for dispensing water spray 42 substantially onto the dark or reflective shade panels 22.

Figure 3:
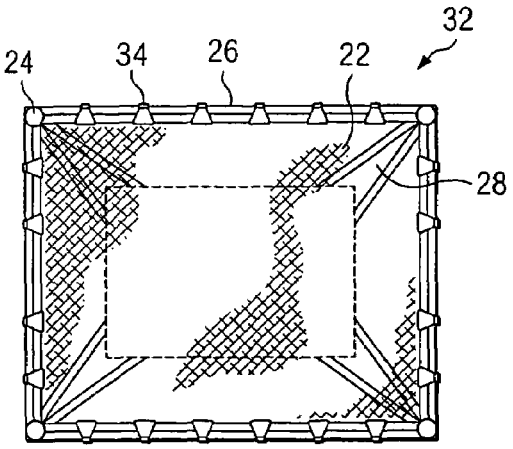
FIG. 3 illustrates a top view of a shade box according to the teachings of the present invention.

Referring to FIG. 3, shade box 32 is positioned around rooftop fixture 20. Upright support posts 24 are attached to fixture support platform 28. Cables 26 are attached to support posts 24 and dark shade panels 22 are fastened to cables 26 with fasteners 34.

Figure 4:
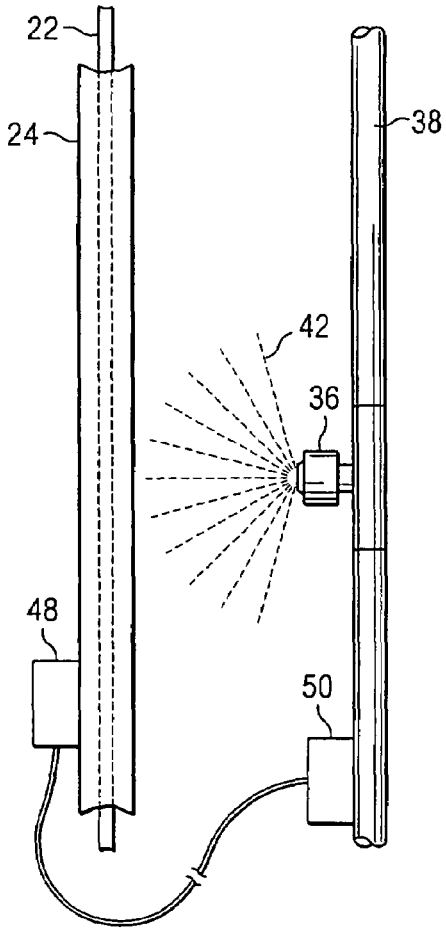
FIG. 4 illustrates a side elevational view of a sprinkler assembly, a sensor and a controller according to the teachings of the present invention.

Referring to FIG. 4, a water dispensation conduit 38 provides water to spray nozzle 36 which dispenses water spray 42 substantially onto dark shade panels 22. Sensor 48 mounted on upright support post 24 sends information to controller 50 which selectively controls water dispensation.

Figure 5:
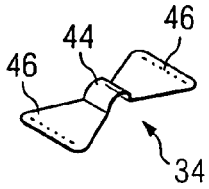
FIG. 5 illustrates a perspective view of a fabric fastener according to the teachings of the present invention.

Referring to FIG. 5, fastener 34, in the unclosed position includes a central raised area 44 through which cable 30 (as shown in FIG. 1) may pass when two flaps 46 which are brought into proximity around the fabric of a shade panel when the fastener is brought to a closed position.

Figure 6:
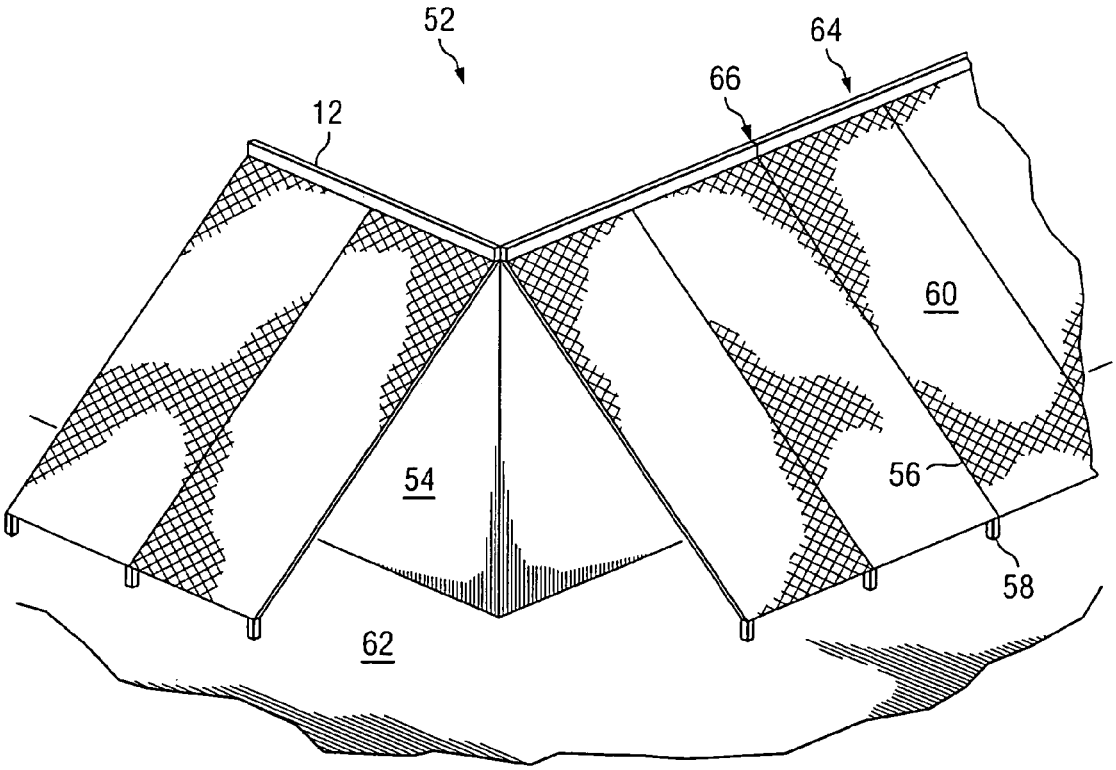
FIG. 6 illustrates a side view of a building equipped with an exterior wall shade assembly according to the teachings of the present invention.

Referring to FIG. 6, to form wall shade assembly 52, support assembly 64 cables 56 are attached to roof 12 or the upper region of exterior wall 54 near the roof with anchors 66 and are attached to the ground 62 by anchors 58. Reflective shade panels 60 are attached to cables 56 with fasteners 34. Alternative fasteners and a variety of anchors will be apparent to one skilled in the art.

Alternatively, wall shade assembly 52 may be placed in any manner so that shade panels 60 are not predominantly lying against the wall. Support assemblies other than assembly 64 described above will be apparent to one skilled in the art. For instance, a scaffolding structure placed near the wall and covered with reflective shade panels may be used within the scope of the present invention.

Reflective shade panels 16 and 60 may be white, silver or any similar hue which has high reflectivity of the sun's light or heat and/or high infrared emissivity. The panels may be selected by testing the reflective shade material for degree of reflectivity and emissivity in the same manner that testing is done to establish effectiveness of white or "cool roof" coating products. Alternatively, some work has been commissioned by the American Society of Agricultural Engineers that involved comparative testing of shade panel materials. One such study is provided in Willis, D. H., "Effect of Cloth Characteristics on Misted-Shade Cooling Performance", Am. Soc. of Ag. Eng., Chicago, Ill., Jun. 18-23, 1995. Although fabric shade panels are used in exemplary embodiments, other types of panels may be used within the scope of the present invention. For instance, vinyl coated polyester shade screens sold under the trademarks SunTex 80® or SunTex 90® by Phifer Wire Products, Inc. in the "Stucco" color are suitable.

Dark shade panels 22 may be black, dark grey, dark brown or any other hue which has a low reflectivity of the sun's light or heat. Panels 22 may be made from water absorbent fabric. In an exemplary embodiment, dark shade panels 22 are rectangular and are constructed of polypropylene shade fabric, for example as sold under trademark NICO-SHADES® by TC Baycor Corporation. For an 80% shade factor, the shade fabric has a weight of 3.7 ounces/square yard, an air porosity of about 700 cfm, with the polypropylene yarn having an oval warp and a round fill. In another exemplary embodiment, dark shade panels 22 are rectangular and are constructed of black vinyl-coated polyester, for example as sold under the trademarks SunTex 80® or SunTex 90® by Phifer Wire Products, Inc. in the black, grey or brown color.

Both reflective and dark shade panels may also be made of non-fabric or non-woven materials. Such materials may be lightweight and may be rigid or flexible. In an exemplary embodiment, the shade panels are made of a lightweight molded material in a rectangular shape.

In another exemplary embodiment, reflective shade panels are approximately 30-60% shade factor, at least 60% shade factor or better, at least approximately 80% shade factor or better, or at least approximately 90% shade factor or better. They may also be approximately 25-65% reflective, at least approximately 65% reflective, at least approximately 70% reflective, or at least approximately 80% reflective. Shade factor effects in particular, and also to some degree reflectivity effects, may be obtained by using layers of such shade panels. While each individual panel may possess the above shade factor or reflectivity characteristics, this is not necessarily required. Rather, for instance, a vertical column above the roof including layers of several such panels may also be used to obtain the desired characteristics.

So long as the desired blocking/reflectivity properties are conserved overall for the roof or exterior wall or portions thereof, shade panels or overall shade assemblies may be altered for aesthetic, commercial or other reasons. For instance, shade panels covering walls may be selected to match the underlying wall, surrounding vegetation, or otherwise to provide a desired color. Shade panels surrounding walls may also be selected so that reflectivity of visible light, or glare does not pose a traffic hazard. Similar panels may also be used on roofs of buildings near airports or where low-glare is otherwise required or advantageous. Additionally, advertisements or other symbols may be printed or applied by other methods such a custom-weaving or silking on the shade panels for commercial or decorative reasons. In other embodiments, the panels may be backlit at night for decorative or commercial purposes.

Additionally, photovoltaic cells may be affixed to the shade panels. These photovoltaic cells may be used to generate electricity, which may be used within the building or supplied to a power grid. Many electric companies will pay for electricity returned to their power grid.

Shade panels may be attached to the cables using fastener 34 or using any other appropriate fastener or retention system including ties, retention hooks or adhesives. In another embodiment, shade panels may be attached to support posts using retention hooks. Other fasteners which may be used in certain embodiments of the present invention include Simpson Strong-tie fasteners and well as fasteners marketed by Pak-Unlimited. Fasteners of the present invention may be automatically detachable when sufficient force is applied. This may allow automatic detachment of the shade panels in the case of excessive rain, snow or ice, or falling objects.

Shade box 32 may include rigid support beams which may connect the support posts or connect to other parts of the rooftop fixture or its platform. Dark shade panels 22 may be attached to rigid support beams 24 in addition to or in place of attachment to cables 30.

Other embodiments of the invention (not explicitly shown) include water recovery or harvesting systems. Such systems may include gutters, piping and other devices that allow recollection of the water used elsewhere in the building, or in fuel cells, or collection of rainwater. The recovery system may be placed underneath the shade panels or around the sides of the building, but may also be located above the panels, particularly if the water recovery system is reflective. The water recovery system is operably attached to and provides water to the water delivery system it may be supplemented by another water source such as the building's normal water supply. Use of the water recovery system improves the water-efficiency of the shade assembly. The water recovery system, in some embodiments, may include a manifold line and pump.

In an exemplary embodiment of the present invention, the water for misters may be supplied at least partially using a water recovery system such as that described at www-.ci.austin.tx.us/watercon/rainwaterschematic.pdf, (accessed Sep. 19, 2002). Alternative systems may also be used to retain the water at roof-level. Misting systems may also include fan-based systems such as those manufactured by ThermalDyn.

The water delivery system such as that shown in FIG. 4 may be controlled in any manner appropriate to meet water efficiency and installation and operational cost concerns for a given structure. In an exemplary embodiment, the system may be activated by electronic, programmable controller 50 and/or a computer-controlled building management program, either of which may utilize sensors 48 mounted on the building's roof. Sensors 48 utilized as part of a control system may include temperature/humidity sensors and/or pyranometers for sensing solar radiation levels. Sensors 48 may also include rain/moisture gauges as well as wind speed sensors. There may be little or no need to dispense water on rainy or windy days. Additional sensors 48 may also be mounted within shade box 32. Sensors 48 may be powered by solar panels installed on the rooftop with battery or other backup power, if desired. Information regarding local weather conditions may also be obtained from outside information services such as those readily available over the internet and used to regulate water delivery. In a simpler embodiment, the water delivery system may be time activated. The invention also contemplates the use of a manual control of the water delivery system in some applications, such as in climates where continuous water delivery during the day may be desirable.

Additionally, in regions where water supply is a concern, water may be applied only at certain time of the year or when conditions dictate water application, because its benefit outweighs the cost or because there is currently no water shortage. However, in any region without abundant water, application may be carefully controlled and monitored by either human or electronic means.

Although shade assembly 10 for example, or other shade assemblies of the present invention will absorb only a fraction of the heat an uncovered roof would absorb, shade assembly 10 will nevertheless experience some increase in temperature during daylight hours and this thermal energy will be partially transferred to the building through the support posts 24 and/or cables 30. In order to minimize heat transfer to a building from a shade assembly of the present invention, insulating materials may be placed where, for example support posts 24 or cables 30 attach to the building, roof, rooftop fixture, walls, etc. Areas where support posts 24 or cables 30 attach to a building may also be cooled by misting those areas with water, thereby decreasing heat transfer to the building. Such a misting system may be integrated into or may operate independent of a sensor/control system for shade box 32.

Any type of rooftop fixture 28 which generates heat or is likely to be damaged by excessive heat may be placed within shade box 32 of the present invention. Such rooftop fixture 20 includes, but is not limited to air conditioning units, ice producing equipment of chiller systems, and elevator fixture.

Anchors 18, for example or other anchors used in any shade assembly of the present invention may be attached to any portion of the building or rooftop structures so long as shade panels 16 and cables 30 will be suspended above the rooftop. In an exemplary embodiment, such as that of FIG. 2, anchors 18 are attached to the interior of the facade or parapet wall. Anchors 18 may also be placed as necessary on rooftop fixture 20 and structures such as air conditioner support platform 28. Cables 30 may also be attached to upright support posts 24 which form part of shade box 32. Modifications to the exterior walls of the building or to rooftop structures may be necessary to facilitate appropriate attachment of anchors 18. One possible modification of a building lacking a parapet wall may be the addition of upright posts, such as posts approximately 2 feel tall or less, along the roof edge to which cables 30 may be attached. In certain embodiments, anchors may be of the type sold by Pak-Unlimited. In another embodiment, the reflective shade panels may be attached to an array of upright support posts with or without transverse stabilizing beams placed on the roof.

When needed, strong-lightweight styrofoam or other lightweight polymer blocks (not expressly shown) such as types commonly available for construction uses may be placed under the cables. Such blocks are often made of wood or fiber reinforced concrete or other similar composites. In an exemplary embodiment, they may be placed where the cables attach to the anchors or shade box support poles and where cables 26 or 30 cross each other. The blocks provide load-bearing support to the cables, but are not likely to damage the roof. The blocks may be attached firmly to the roof surface with glue or other suitable adhesives. A low wall of the blocks may be constructed around the exterior of a roof lacking a parapet wall to provide a substitute structure to which anchors 18 may be attached. In a further exemplary embodiment of the invention, the blocks may be polystyrene blocks such as those commonly used as insulated concrete forms. In particular, they may be blocks such as those supplied by Logix Insulated Concrete Solutions (Wichita, Kans.). The blocks may also be recycled styrofoam products such as those supplied by Hoamfoam Alliance, Inc. (Austin, Tex.).

In another embodiment of the invention, an array of upright support posts may be placed upon the roof and reflective shade panels may be attached to the posts by fasteners, retention hooks, or other retention mechanisms. For instance, a post with one or more retention hooks may be placed at the corners of rectangular shade panels. These posts may be reinforced with an array of lateral and transverse beams, which interconnect to support the posts.

Shade box 32 may be formed or constructed in a variety of shapes designed to suit the fixture to be covered, including rectangular conformations as shown in FIGS. 2, and 3-4 in octagonal conformations. For shade box configurations that are not rectangular, it may be appropriate to use a rectangular top shade panel even though this will result in only partial coverage of the rooftop fixture. Upright support posts 24 may attach at a right angle to fixture 20 or platform 28. Alternatively, support posts 24 may attach laterally to fixture platform 28 and extend outward in the plane of roof 12 then turn upwards at a right angle as shown in FIG. 2. Shade box 32 should be spaced an appropriate distance from the fixture so as not to block necessary air flow. Shade panels 22 may be reflective or dark. In an exemplary embodiment, they are dark in a shade box 32 where water is dispensed substantially onto the panels and reflective in a shade box 32 where no water is dispensed. Embodiments using a reflective shade box 32 may be particularly well-suited for use in windy or arid regions In an exemplary embodiment, one side of shade box 32 is mounted so as to pivot outward like a door, allowing easier access to fixture or other objects contained within the shade box.

The shade assembly portion that is reflective (made up of reflective panels 16 and, in some embodiments, reflective shade panels 22) and covers roof 12 may be placed at any distance above the roof. In an exemplary embodiment, the reflective portion is approximately six inches to two feet or approximately six inches to one foot above the roof. Spacing of other shade assemblies from walls or exterior surfaces may be by similar distances.

In an exemplary embodiment of the present invention, shade panels may be placed at any angle in relation to the roof or exterior wall. In specific embodiments, the shade panels are placed at an angle so as to optimally block solar radiation at a selected time of day. Arrays of movable panels that track the sun's movement for optimal blockage are also contemplated within the present invention.

Because the shade assemblies of the present invention may cover a substantial portion of the exterior surface of a building, access behind or under the panels may periodically be required for maintenance or other reasons. In order to allow such access, all or part of a roof shade assembly may be designed so that it may be collapsed to lay flat on the roof to allow access, prevent breakage under heavy weight, or for other reasons. In one embodiment, the collapsible assembly may be supported by deflatible air bags. Anchors and/or upright support posts may also be designed to allow collapse. Alternatively, spring anchors may provide needed temporary collapsibility. The collapse mechanism may be easily reversible to the uncollapsed position. It may also be possible to design the support assembly to allow easy removal and reinstallation of the entire shade assembly. Alternatively, the shade panels may be mounted in a fashion normally employed for certain roof solar panels, such as the Unirac system. On some roof surfaces, such as rubber roofs, the panels may be laid directly on the roof. In embodiments where shade panels in pathways are near or on the roof surface, insulation, such as styrofoam, underneath the panels may be added. Additionally, for very regular access, regions of the roof may selectively be left uncovered. Although these regions will continue to absorb substantial heat from sunlight, the other regions which are covered will not do so and, therefore, a net energy savings will still result.

Similarly, access behind the wall shade assemblies of the present invention may be required. In the embodiment depicted in FIG. 6, the angling of the shade assembly away from the wall may be adjusted to allow access under the assembly at any time. Alternatively, the anchors may be designed for easy release so the shade panels may be moved or rolled up. If a scaffold system is used, it may be configured to allow easy movement of entire scaffold sections or easy removal of the shade panels from the scaffold. Other configurations and choice of components may be selected by one skilled in the art to allow necessary access depending upon, inter alia, the building layout and access needs.

In certain embodiments, the overall shade assembly including any shade boxes may be supported by structures incorporated into building designs for this purpose.

If significant amounts of metal components are used in the shade assemblies of the present invention, particularly the roof assemblies, addition of a lightning rod system to the building may be advisable. Alternatively, the assemblies may be configured so as to not impede the function of existing lightning rod systems. Although many of the materials suitable for use as shade panels may not be highly flammable, in areas or on buildings with particularly high rates of lightning strikes, shade panels with very low to no flammability may be selected.

In addition to producing various energy-related efficiencies by reducing the amount of heat absorbed by a structure, the present invention may also provide beneficial effects to rooftop fixtures. Many types of fixtures are stressed by heat. Such stress is reduced by the present invention, thereby improving both equipment life and efficiency. Additionally, the present invention provides protection to both equipment and covered exterior building surfaces by blocking some physical damage, such as that caused by hail In addition to the above exemplary embodiments in which a building is covered with a shade assembly, structures on or near the ground such as parking lots may also be covered with a reflective, water-permeable shade assembly. In an embodiment of the invention where parking lots are covered (not explicitly shown), the shade assembly is high enough above the parking lot to allow normal parking and movement of vehicles. Additionally, the assembly is supported by upright posts and cables in such a manner as to allow movement and access to vehicles. In certain embodiments, lighting rods or other upright structures with additional utilities may be used to support the shade assembly. In this embodiment, reflective shade panels which are water permeable may be used so that rain will substantially pass through the shade panels and will not substantially pool on top of the panels. This allows for the assembly of substantially horizontal shade assemblies where desirable.

The shade assemblies of the present invention may be used to reduce the solar heat load on such a shaded structure in excess of 50% in warmer climates. This results in considerable energy use reduction for the shaded structures, primarily because of the decreased need for energy-consumptive cooling methods. In many areas around the world, the shading method of the present invention provides a savings in energy costs. However, in many countries, additional economic incentives are provided for increased energy efficiency. The tendency to provide such incentives will likely increase as the high costs of inefficiency become apparent, resulting in a very large market relating to energy efficiency. Some of these costs and projected markets are described in a recent United Nations report, summarized in GreenBiz.com "Banks Say Tackle Climate Change or Face the Consequences" (accessed on Oct. 23, 2001 at http://www.greenbiz.com/news/printer.cfm?NewsID=22643).

In the U.S. emission reduction credits may be provided to businesses which are falling below certain energy consumption minimums. Such businesses are primarily in the manufacturing or industrial sector. These credits can be banked for future use if the company falls out of regulatory compliance or when the company wishes to expand its facilities within a field that produces poor air quality or within a geographic area with poor air quality, such an a non-attainment area. They can also be sold to other companies which are not meeting regulatory compliance standards. Thus, these energy reduction credits have substantial economic value. Other energy reduction incentives also exist. In addition, certain energy-efficient technologies are recognized as such through programs such as the U.S. government's "Energy Star" program. Other countries currently use similar programs to encourage energy efficiency or are likely to adopt such programs in the future.

The energy performance of a prior, less water efficient roof shading system as embodied in U.S. Pat. No. 6,161,362 has been evaluated by Joe Huang (DOE-2 Computer Simulations—Forbis Shadecover Technology, October, 2001, not publicly disclosed, the "Huang Study"). Using the Department of Energy's modeling system, the prior roof shading system was predicted to reduce energy consumption of buildings in warm, dry climates by 20-27% and energy consumption in warm, humid climates by between 12 and 18%. Systems of the present invention can be expected to achieve results at least as good as the results of the prior system. In humid climates the present invention, because it is not necessarily water-dependant is expected to achieve even more energy efficiencies than the prior system.

The Huang study also provided some modeling of less water-intensive systems that fall within the scope of the present invention. Energy savings and other characteristics of an embodiment of the present invention modeled in the Huang study are presented in Table 1.

TABLE 1

Forbis Shadecover Technology - 80% Shade Factor Cloth Application (without mist)

| Facility Location | Old/New Store | A/C KWH Saved * | Pounds of A/C based $CO_2$ Emissions Avoided ** | Total KWH Saved * | Total Pounds of $CO_2$ Emissions Avoided ** |
|---|---|---|---|---|---|
| Houston, TX | Old | 30691 | 46036 | 72698 | 109047 |
| Houston, TX | New | 16915 | 25372 | 40174 | 60261 |
| San Antonio, TX | Old | 31136 | 46704 | 75508 | 113262 |
| San Antonio, TX | New | 20069 | 30103 | 48646 | 72969 |
| Atlanta, GA | Old | 32255 | 48382 | 74897 | 112345 |
| Atlanta, GA | New | 17616 | 26424 | 44720 | 67080 |
| Las Vegas, NV | Old | 33685 | 50527 | 77808 | 116712 |
| Las Vegas, NV | New | 15966 | 23949 | 40636 | 60959 |
| Phoenix, AZ | Old | 32269 | 48403 | 73403 | 110104 |
| Phoenix, AZ | New | 19004 | 28656 | 44590 | 66885 |

* From Tables 3a & 3b, "The Energy Performance of a Combined Roof Mist Shading System", Dr. Joe Huang, October 2002.
** Calculations based on a 1.5 U.S. National Avg. Emission Factor for $C0_2$. Actual emission factors vary by region and over time.

Accordingly, the present invention also includes using the shade assemblies described above to obtain governmental economic rewards or acknowledgment for improved energy efficiency. For instance, use of the present invention on a building may allow certification of the building as a zero net energy building.

The shade assemblies of the present invention may also be used to mitigate the heat island effect of large urban or paved areas.

Although only exemplary embodiments of the invention are specifically described above, it will be appreciated that modifications and variations of the invention are possible without departing from the spirit and intended scope of the invention.

What is claimed is:

1. A shade assembly comprising:

a first array of reflective shade panels suspended in an operative position above a roof of a building;

a shade box comprising a second array of shade panels, wherein the shade box is sized to cover at least one roof top fixture; and a support assembly operative to suspend the first array of reflective shade panels, wherein the first support assembly includes:

cables operably attached to a parapet wall or support posts by anchors;

fasteners operable to attach the shade panels to the cables; and lightweight polymer blocks placed beneath the cables to provide support for the cables.

2. The shade assembly of claim 1, wherein the first array of shade panels is suspended approximately six inches to two feet above the roof of the building.

3. The shade assembly of claim 1, wherein the first array of shade panels is suspended approximately six inches to one foot above the roof of the building.

4. The shade assembly of claim 1 further comprising reflective shade panels that are at least approximately 25% reflective or provide at least approximately 30% shade factor.

5. The shade assembly of claim 1 further comprising reflective shade panels that are at least approximately 65% reflective or provide at least approximately 60% shade factor.

6. The shade assembly of claim 1 further comprising reflective shade panels that are white, silver or beige.

7. The shade assembly of claim 1 further comprising fabric shade panels.

8. The shade assembly of claim 1 further comprising non-fabric non-woven shade panels.

9. The shade assembly of claim 1 further comprising collapsible anchors operable to facilitate roof access.

10. The shade assembly of claim 1 further comprising detachable anchors to facilitate removal of the first support assembly.

11. The shade assembly of claim 1 wherein the first support assembly further comprises:

an array of upright support posts placed upon the roof; and retention mechanisms operable to attach the shade panels to the upright support posts.

12. The shade assembly of claim 1 further comprising an unshaded area of the roof to allow roof access.

13. The shade assembly of claim 1 further comprising a third array of reflective shade panels in an operative position between approximately 0 and 6 inches above a region of the roof to allow roof access.

14. The shade assembly of claim 1 further comprising a third array of reflective shade panels located beneath and substantially parallel to the first array of shade panels.

15. The shade assembly of claim 1 further comprising a second array of fabric shade panels.

16. The shade assembly of claim 1 further comprising a second array of non-fabric or non-woven shade panels.

17. A shade assembly, comprising:

a first array of reflective shade panels suspended in an operative position above a roof of a building;

a shade box comprising a second array of shade panels, wherein the shade box is sized to cover at least one roof top fixture;

a support assembly operative to suspend the first array of reflective shade panels, wherein the first support assembly includes:

cables operably attached to a parapet wall or support posts by anchors;

fasteners operable to attach the shade panels to the cables; and a second support assembly operative to form the shade box, the second support assembly including:

at least one support post attached in an operable position to the rooftop fixture or a fixture support platform;

cables operable attached to the support posts; and fasteners operable to attach the shade panels to the cables, wherein the second support assembly is operable to allow at least one side of the shade box to pivot outward for access to the rooftop fixture.

18. A shade assembly comprising:

a first array of reflective shade panels suspended in an operative position above a roof of a building;

a second array of dark shade panels operative to form a shade box, wherein the shade box is sized to cover at least one rooftop fixture;

at least one spray nozzle coupled to a water distribution system operable to dispense water substantially onto the dark shade panels;

an electronic programmable controller or a computer-controlled building management program operable to regulate the water distribution system; and at least one sensor mounted on the roof wherein the sensor provides information to the controller used to regulate the water distribution system.

19. The shade assembly of claim 18 further comprising at least one sensor selected from the group consisting of temperature sensors, humidity sensors, pyranometers, rain or moisture gauges, and wind speed sensors.

20. The shade assembly of claim 18, further comprising;

a wall assembly including:

a third array of reflective shade panels in a position operative to shade at least one exterior wall of the building and spaced between approximately six inches and two feet away from the exterior wall; and a parking lot shade assembly including:

a fourth array of reflective shade panels in a position operative to both shade a parking lot adjacent to the building and allow use of the parking lot to park motor vehicles, wherein all reflective shade panels are at least approximately 25% reflective or provide at least approximately 30% shade factor.

21. A shade assembly comprising:

a first array of reflective shade panels suspended in an operative position above a roof of a building;

a second array of dark shade panels operative to form a shade box, wherein the shade box is sized to cover at least one rooftop fixture;

at least one spray nozzle coupled to a water distribution system operable to dispense water substantially onto the dark shade panels;

an electronic programmable controller or a computer-controlled building management program operable to regulate the water distribution system; and a source providing local weather information to the controller wherein the weather information is used to regulate the water distribution system.

22. The shade assembly of claim 21, further comprising;

a wall assembly including:

a third array of reflective shade panels in a position operative to shade at least one exterior wall of the building and spaced between approximately six inches and two feet away from the exterior wall; and a parking lot shade assembly including:

a fourth array of reflective shade panels in a position operative to both shade a parking lot adjacent to the building and allow use of the parking lot to park motor vehicles, wherein all reflective shade panels are at least approximately 25% reflective or provide at least approximately 30% shade factor.

23. A shade assembly comprising:

a first array of reflective shade panels suspended in an operative position above a roof of a building;

a second array of dark shade panels operative to form a shade box, wherein the shade box is sized to cover at least one rooftop fixture;

at least one spray nozzle coupled to a water distribution system operable to dispense water substantially onto the dark shade panels;

a controller operable to regulate the water distribution system; and a manual controller to regulate the water distribution system.

24. The shade assembly of claim 23, further comprising;

a wall assembly including:

a third array of reflective shade panels in a position operative to shade at least one exterior wall of the building and spaced between approximately six inches and two feet away from the exterior wall; and a parking lot shade assembly including:

a fourth array of reflective shade panels in a position operative to both shade a parking lot adjacent to the building and allow use of the parking lot to park motor vehicles, wherein all reflective shade panels are at least approximately 25% reflective or provide at least approximately 30% shade factor.

25. A shade assembly comprising:

a first array of reflective shade panels suspended in an operative position above a roof of a building;

a shade box comprising a second array of shade panels, wherein the shade box is sized to cover at least one roof top fixture; and a support assembly operative to suspend the first array of reflective shade panels, wherein the first support assembly includes:

cables operably attached to a parapet wall or support posts by anchors; and fasteners operable to attach the shade panels to the cables;

a wall assembly including:

a third array of reflective shade panels in a position operative to shade at least one exterior wall of the building and spaced between approximately six inches and two feet away from the exterior wall; and a parking lot shade assembly including:

a fourth array of reflective shade panels in a position operative to both shade a parking lot adjacent to the building and allow use of the parking lot to park motor vehicles, wherein all reflective shade panels are at least approximately 25% reflective or provide at least approximately 30% shade factor.

* * * * *